US008505226B2

(12) United States Patent
Vesligaj

(10) Patent No.: US 8,505,226 B2
(45) Date of Patent: Aug. 13, 2013

(54) RECOIL REDUCING ASSEMBLY FOR AUTOLOADING FIREARMS

(76) Inventor: Zeljko Vesligaj, Burgaw, NC (US)

( * ) Notice: Subject to any disclaimer, the term of this patent is extended or adjusted under 35 U.S.C. 154(b) by 21 days.

(21) Appl. No.: 13/438,898

(22) Filed: Apr. 4, 2012

(65) Prior Publication Data

US 2012/0260552 A1 Oct. 18, 2012

Related U.S. Application Data

(60) Provisional application No. 61/517,369, filed on Apr. 18, 2011.

(51) Int. Cl.
*F41C 23/06* (2006.01)

(52) U.S. Cl.
USPC ..... 42/74; 42/1.06

(58) Field of Classification Search
USPC ..... 42/1.06, 71.01, 72, 73, 74
See application file for complete search history.

(56) References Cited

U.S. PATENT DOCUMENTS 1,412,017 A * 4/1922 Johnson ..... 42/105
2,455,438 A * 12/1948 Edward ..... 42/74
2,731,753 A * 1/1956 Mathieu ..... 42/74
3,290,815 A * 12/1966 Edwards ..... 42/74
3,300,889 A * 1/1967 Baker ..... 42/74
3,346,985 A * 10/1967 Browning ..... 42/74
3,381,405 A * 5/1968 Edwards ..... 42/74
3,405,470 A * 10/1968 Wesemann ..... 42/74
3,461,589 A * 8/1969 Vironda ..... 42/74
3,754,344 A * 8/1973 Spiliotis ..... 42/74
4,164,825 A * 8/1979 Hutchison ..... 42/1.06
4,279,091 A * 7/1981 Edwards ..... 42/1.06
4,769,937 A * 9/1988 Gregory et al. ..... 42/74
4,986,018 A * 1/1991 McDonald, Jr. ..... 42/1.06
5,031,348 A * 7/1991 Carey ..... 42/74
5,343,649 A * 9/1994 Petrovich ..... 42/1.06
5,909,002 A * 6/1999 Atchisson ..... 89/130
6,732,466 B2 * 5/2004 Bentley ..... 42/74
7,380,487 B2 6/2008 Mantras
7,478,495 B1 1/2009 Alzamora et al.
7,493,845 B2 2/2009 Mantas
7,681,351 B2 3/2010 Bucholtz et al.
7,823,313 B2 11/2010 Faifer
8,051,593 B2 * 11/2011 Vesligai ..... 42/73
8,176,668 B2 * 5/2012 Simms et al. ..... 42/1.06
2004/0031182 A1 * 2/2004 Bentley ..... 42/74
2008/0110074 A1 * 5/2008 Bucholtz et al. ..... 42/1.06
2008/0178508 A1 * 7/2008 Cinciu ..... 42/1.06
2010/0050492 A1 3/2010 Faifer
2010/0071246 A1 * 3/2010 Vesligai ..... 42/75.03
2010/0088942 A1 4/2010 Petruj
2010/0122482 A1 5/2010 Simms et al.

(Continued)

*Primary Examiner* — Jonathan C Weber
(74) *Attorney, Agent, or Firm* — MacCord Mason PLLC

(57) ABSTRACT

A recoil-reducing stock assembly for an autoloading shotgun or rifle that includes a receiver with a rear face and a spring tube extending rearwardly from the receiver rear face is described. The assembly includes a pistol grip against the receiver rear face having a spring tube bore; a stock having a spring tube recess and a connector tube cavity; a connector tube with a bore attachable at selected positions to the stock within the connector tube cavity; a tubular conduit slidably inserted over the spring tube and slidable and non-rotatable within the connector tube bore, the tubular conduit having a front end non-rotatably attached to the pistol grip; and a compressible spring inserted over the front tubular conduit and between the connector tube and the pistol grip to buffer recoil.

20 Claims, 3 Drawing Sheets

(56) References Cited

U.S. PATENT DOCUMENTS

2010/0251587 A1 10/2010 Kincel
2010/0251588 A1 10/2010 Kincel
2011/0179687 A1* 7/2011 Caravaggi et al. ..... 42/1.06
2012/0260552 A1* 10/2012 Vesligaj ..... 42/1.06

* cited by examiner

RECOIL REDUCING ASSEMBLY FOR AUTOLOADING FIREARMS

This application claims the benefit of the filing date of U.S. Provisional Application Ser. No. 61/517,369, filed Apr. 18, 2011, which is incorporated herein in its entirety.

BACKGROUND OF THE INVENTION (1) Field of the Invention

The present invention relates generally to recoil reducing stock assemblies for autoloading firearms, e.g., shotguns and rifles, and in particular to a recoil reducing stock assembly that is attachable to an autoloading firearm having a rearwardly extending spring tube.

(2) Description of the Prior Art

Several prior art inventions describe mechanisms for damping the recoil of a shotgun or rifle when fired, thereby lessening the discomfort to the shooter. Most of these recoil systems position a compressible spring between the stock and the receiver, with the spring being momentarily compressed when the shotgun or rifle is fired, absorbing some of the recoil force. These recoil systems along with a stock are often designed as aftermarket replacement systems that are attached to the shotgun or rifle receiver in place of the original stock.

Conventional recoil systems are not suitable for use with autoloading firearms, the term being used herein to encompass shotguns and rifles, that include a rearwardly extending tube having a spring that is momentarily compressed when the firearm is fired, with the return of the spring serving to reload the next shell or round. The presence of this tube interferes with the mounting of previously available recoil mechanisms and stocks, together referred to as the stock assembly.

Two challenges must be overcome in designing a stock assembly for attachment to an autoloading firearm having a rearwardly extending action spring tube. First, the stock assembly must be insertable over the spring tube when attached to the firearm receiver. Second, the stock assembly must be non-rotatable relative to the firearm receiver when attached. The recoil reducing stock assembly of the present invention meets these requirements.

SUMMARY OF THE INVENTION

Generally, the present stock assembly is specifically designed for mounting on an autoloading firearm having a receiver with a rear face and a spring tube that extends rearwardly from the receiver rear face. The assembly is comprised of a pistol grip, a stock, a connector tube, a tubular conduit, a compressible spring, a locking member, and a butt plate.

The pistol grip has a grip front face that is positionable against the receiver rear face, a grip hack face, and a spring tube bore that extends between the grip front and back faces. The stock has a front end, a rear face with a spring tube extension recess, and a connector tube cavity.

The connector tube is mountable within this connector tube cavity, and is attachable at selected positions to the stock. The connector tube has a front end, a back end, and a bore extending between the connector tube front and back ends.

A tubular conduit is slidably insertable over the spring tube and in the connector tube bore, and is non-rotatable within the connector tube bore. The front end of the tubular conduit is non-rotatably attachable to the pistol grip.

A compressible spring is insertable over the front tubular conduit and between the front end of the connector tube and the rear of the pistol grip. A locking member, e.g., a nut, is attachable to the rear end of the spring tube to secure the front end of the conduit to the pistol grip, the nut being against the rear ends of the tubular conduit and the connector tube when the spring is uncompressed and spaced from the rear of the conduit tube when the spring is compressed.

The pistol grip also includes a hand grip, a rearwardly facing spring receiver coaxial with the spring tube bore that extends through the hand grip. The grip also includes an annular rear face surrounding the rear of the bore. The hand grip spring receiver includes a rear face and cylindrical bore that is enlarged at its rear end to receive the spring, which abuts a shoulder between the front and rear sections of the bore.

The connector tube is configured to be mountable at selected positions within the stock to adjust the distance from the rear of the stock to the receiver within this connector tube cavity, and is attachable at selected positions to the stock. A latching member joins the connector tube to the stock at selected locations. For example, the connector tube may include a lower protrusion that includes a plurality of spaced upwardly projecting recesses, while the stock includes a retractable pin that is selectively insertable into one of the recesses.

The connector tube bore extending between the connector tube front and back ends has a non-circular cross-section along at least a part of its length. That is, the connector tube bore can have a uniform non-circular cross section along its entire length, or a section of the bore may have a non-circular cross-section, while the remainder of the bore may have a circular cross-section.

The tubular conduit has an inner bore with a circular cross-section that is insertable over the spring tube and through the spring retainer bore so that the forward end of the tubular conduit engages the rear annular face of the pistol grip. When the connector tube bore has a uniform non-circular cross-section, the outer cross-section of the tubular conduit has a non-circular cross section corresponding to the non-circular cross-section of the connector tube bore. When the connector tube bore includes a section that has a non-circular cross-section and a section with a circular cross-section, the tubular conduit will also have a corresponding non-circular section and a circular section.

In either event, the non-circular cross-section of the bore and corresponding conduit cross-section prevents rotation of the connector tube and the tubular conduit relative to each other. Since the latching member secures the stock to the connector tube, the stock is also non-rotatable relative to the tubular conduit.

The front end of the tubular conduit and the rear of the pistol grip are attachable to each other, so that the pistol grip will not rotate relative to the tubular conduit. For example, either the front face of the tubular conduit or the annular rear face of the pistol grip includes a projection that is insertable into a recess in the other component so that the tubular conduit and grip are non-rotatable relative to each other when engaged with the projection inserted into the recess.

The tubular conduit may be of a single-piece construction or constructed of multiple axially aligned sections. For example, non-circular and circular sections may be attached end to end. Also the tubular conduit may be formed of multiple sections to accommodate firearms having different length spring tubes. When constructing the tubular conduit of multiple sections, each sections ends that abut another section may include a projection or recess to connect the sections and prevent rotation relative to each other when they are joined.

The spiral compressible spring is positionable over the spring tube and between the end of the connector tube and the pistol grip, so that the spring is compressed when the firearm is fired, causing the recoil to urge the pistol grip, receiver, tubular conduit, and spring tube rearwardly. In a preferred embodiment, the spring is insertable over the tubular conduit and into the rear of the spring receiver of the pistol grip.

The recoil stock assembly is attached to the receiver by sliding its various components onto the spring tube. First, the pistol grip is slid onto the tube until the front face of the pistol grip engages the rear face of the receiver. The tubular conduit is then slid over the spring tube through the spring retainer and into the rear face of the pistol grip until the front edge of the tubular conduit engages the rear annular face of the pistol grip. When joined, the projection of either the tubular conduit or the annular face engages the projection or recess of the other, preventing rotation of the pistol grip and tubular conduit relative to the receiver. The spiral spring is then slid over the tubular conduit and into the rear section of the spring receiver bore. The spring extends rearwardly from the spring recess.

The connector tube is positioned within the stock connector tube cavity and latched at the desired position. The spring tube and surrounding tubular connector are then inserted into the connector tube bore. The lengths of the connector tube and tubular conduits are sized so that the rear end of the spring tube extends rearwardly beyond the tubular conduit. The tubular conduit is inserted so that the rear of the compressible spring engages the front face of the connector tube.

A locking member, e.g., a nut, is then secured to the rear of the spring tube to prevent the tube from being withdrawn from the connector tube. Since the front end of the spring tube is secured to the receiver, tightening of the locking member forces the end of the tubular conduit against the pistol grip whereby the corresponding protrusions and recess of the conduit and grip prevent rotation of the conduit and grip relative to each other. The pistol grip is also secured to the receiver by the force exerted by the locking member.

Therefore, due to the latching to the connector tube to the stock, the non-rotation of the tubular conduit relative to the connector tube and the locking of the grip to the front of the tubular conduit, the stock will not rotate relative to the pistol grip or receiver.

In one embodiment of the invention, the tubular conduit is in multiple sections, with the rear section of the tubular conduit, also referred to herein as a connector plug, is then slid over the spring tube and into a non-circular bore section in the rear of the connector tube until the front face of the connector plug engages the rear face of a front section of the tubular conduit. A projection or recess on the end of the connector plug or conduit engages the corresponding projection or recess of the other component, thereby preventing the connector plug, and as a result, the connector tube, from rotating relative to the tubular conduit.

When this embodiment is assembled, the rear face of the connector plug is in a plane with the rear face of the connector tube, with the threaded end of the spring tube projecting from the connector. A nut having a diameter greater than the diameter of the connector plug, and preferably equal to the diameter of the rear face of the connector tube, is then screwed onto the threaded end of the spring tube to engage the rear face of the connector tube, thereby holding all elements of the stock assembly together and attached to the receiver.

The stock includes a rear face with a recess providing access to the tube nut. A butt plate is releasably fitted to the back of the stock to cover the recess and to provide cushioning against the user's shoulder when the firearm is fired.

When assembled, the autoloading firearm including a receiver with a rear face and a spring tube extending rearwardly from the receiver rear face comprises a pistol grip having a grip front face positionable against the receiver rear face, a grip back face, and a spring tube bore extending between the grip front and back faces; a stock having a front end, a rear face with a spring tube extension recess, and a connector tube cavity; a connector tube mounted within the connector tube cavity, the connector tube being attachable at selected positions to the stock, the connector tube having a front end, a back end, and a bore extending between the connector tube front and back ends; a tubular conduit slidably inserted over the spring tube and in the bore, the tubular conduit being non-rotatable within the connector tube bore, the tubular conduit having a front end non-rotatably attached to the pistol grip; a compressible spring inserted over the front tubular conduit and between the front end of the connector tube and the rear of the pistol grip; and a locking nut attached to the rear end of the spring tube securing the front end of the conduit to the pistol grip, the nut being against the rear ends of the tubular conduit and the connector tube when the spring is uncompressed and spaced from the rear of the conduit tube when the spring is compressed.

When the autoloading firearm is fired, the receiver moves rearwardly under the force of the recoil or blast, also moving the spring tube, pistol grip, and tubular conduit rearwardly. The compressible spring is momentarily compressed between the front face of the connector tube and the rear of the pistol grip by the recoil. Rearward movement of the spring tube forces the rear of the spring tube and the attached nut into the stock butt recess. Instead of all of the force being transmitted totally through the stock to the butt plate, a portion of the force is absorbed by the momentary compression of the spring, which then returns to its uncompressed state.

DETAILED DESCRIPTION OF THE INVENTION

Figure 1:
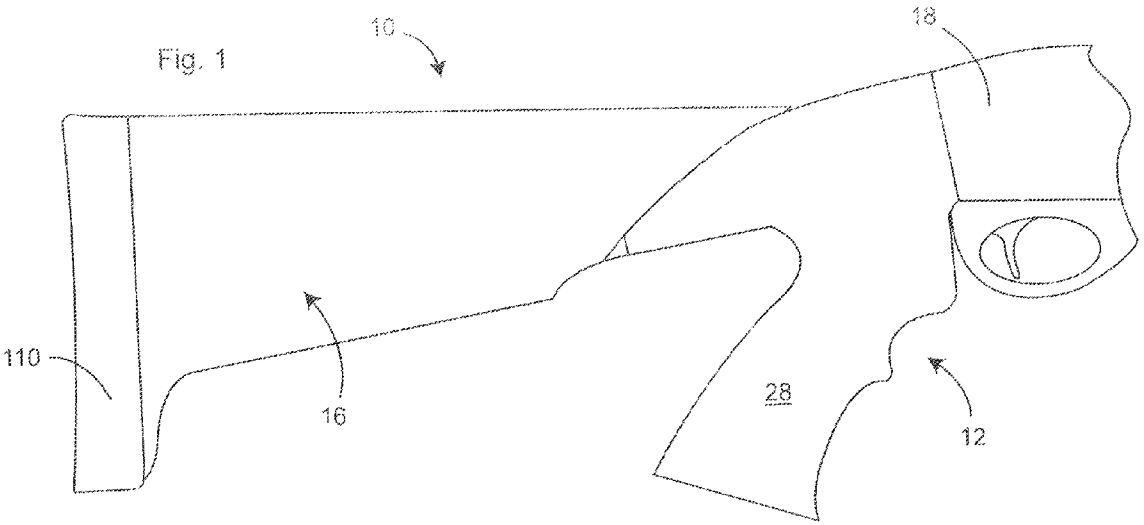
FIG. 1 is a side view of the stock assembly attached to a firearm receiver.
Figure 2:
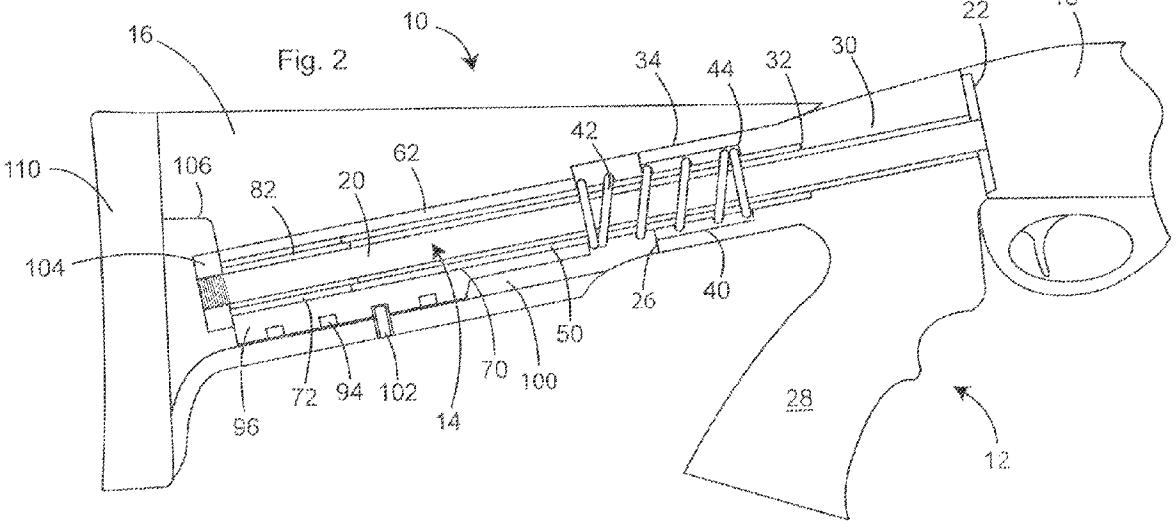
FIG. 2 is a sectional side view of the stock assembly attached to a firearm receiver.
Figure 4:
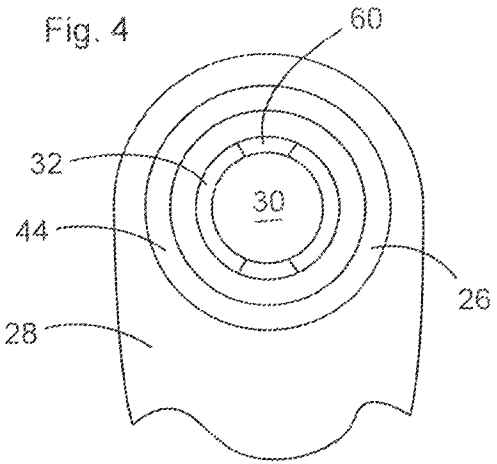
FIG. 4 is a rear view of the pistol grip showing the annular face around the bore.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As seen in the drawings, a preferred embodiment of the stock assembly, generally 10, is comprised of a pistol grip, generally 12, a recoil mechanism, generally 14, and a stock, generally 16. Stock assembly 10 is designed for attachment to autoloading firearm receiver 18, which includes a rearwardly extending spring tube 20.

Pistol grip 12 includes a from face 22 shaped for placement against the rear of receiver 18, a rear face 26, a hand grip 28, and a spring tube bore 30 extending through hand grip 28 between faces 22 and 26. Rear annular face 32 surrounds the rear of spring tube bore 30.

Pistol grip 12 also includes a rearwardly extending spring receiver 34, which includes a cylindrical bore 40. Bore 40 has an enlarged diameter at its rear end to receive a compressible spring 42, which abuts shoulder 44 between the front and rear sections of bore 40. Receiver bore 40 is coaxial with pistol grip bore 28.

Tubular conduit 50 having an inner bore 52 is insertable over spring tube 20 and through spring 42 so that the front end of conduit 50 engages annular face 32. As shown in the preferred embodiment, the front end of conduit 50 includes projections 56 that are inserted into recesses 60 in the annular face 32, preventing conduit 50 from rotating relative to grip 12 and receiver 18.

Connector tube 62 is slidable over spring tube 20 and the rear section of tubular conduit 50. Connector tube 62 includes a front face 64, a rear face 66, and a bore extending between its faces. The bore has a front section 70 extending rearwardly from front face 64, and a rear section 72 extending between front section 70 and rear face 66. Front section 70 has a circular cross-section, while, as shown in the preferred embodiment, rear section 72 has a square exterior cross-section. It will be understood, however, that other non-circular cross-sections can be used.

Spiral compressible spring 42 is insertable over tubular conduit 50 and into the rear of spring receiver 34. The front of spring 42 engages the inner shoulder 44 of receiver 34, and the rear engages the front face of connector tube 62. Rear connector tube bore section 72 is sized to receive connector plug 82, which has a square outer cross-section corresponding to the square cross-section of rear section 72 and an inner bore 84 having a circular cross-section coaxial with, and of the same diameter as, the bore of connector tube front section 70.

Tubular conduit 50 has a rear face with projections 90 that are sized for insertion into recesses 92 in the front face of connector plug 82, preventing connector 82, and thereby connector tube 62, from rotating relative to tubular conduit 50.

Connector tube 62 also includes a plurality of spaced recesses 94 in a protrusion 96 along the lower side of connector tube 62. Stock 16 includes a cavity 100 to receive recoil mechanism 14, and a set screw 102 extending through the stock wall to selectively engage one of recesses 94. When stock 16 is inserted over recoil mechanism 14 and attached by set screw 102 to connector tube 62, stock 16 will not rotate relative to recoil mechanism 14, which in turn is prevented from rotation relative to receiver 18 by the engagement of tubular conduit 50 and pistol grip annular face 32.

When assembled, the rear face of connector plug 82 is in a plane with the rear face of connector tube 62, with the threaded end of spring tube 20 projecting from the rear of connector plug 82. Tube nut 104, which has a diameter equal to the diameter of the rear face of connector tube 62, is screwed onto the distal threaded end of spring tube 20 to engage the rear face of connector tube 62, thereby securing all elements of stock assembly 10 together and attached to receiver 18. Stock recess 106 provides access to the tube nut 104. Butt plate 110 is releasably fitted to the back of stock 16 to provide cushioning against the user's shoulder when the firearm is fired.

When the autoloading firearm is fired, receiver 18 along with attached spring tube 20, pistol grip 12, tubular conduit 50, and nut 104 move rearwardly under the force of the recoil. Compressible spring 42 is momentarily compressed between the front face of the connector tube 62 and the rear of the pistol grip 12 by the recoil. Rearward movement of spring tube 20 forces the rear of the spring tube 20 and attached nut 104 into stock butt recess 106. A portion of the recoil force is absorbed by the momentary compression of spring 42, which then returns to its uncompressed state.

Figure 6:
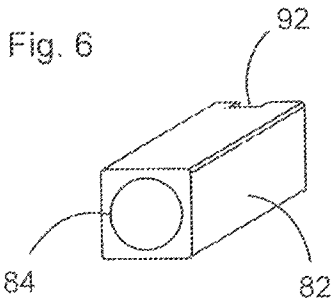
FIG. 6 is a perspective view of the connector tube plug.
Figure 3:
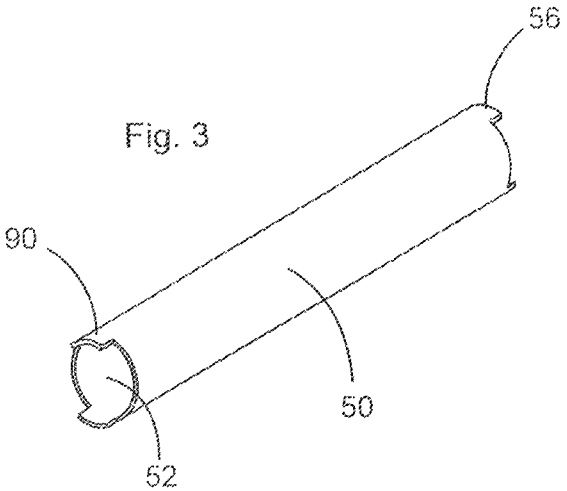
FIG. 3 is a perspective view of the tubular conduit.
Figure 5:
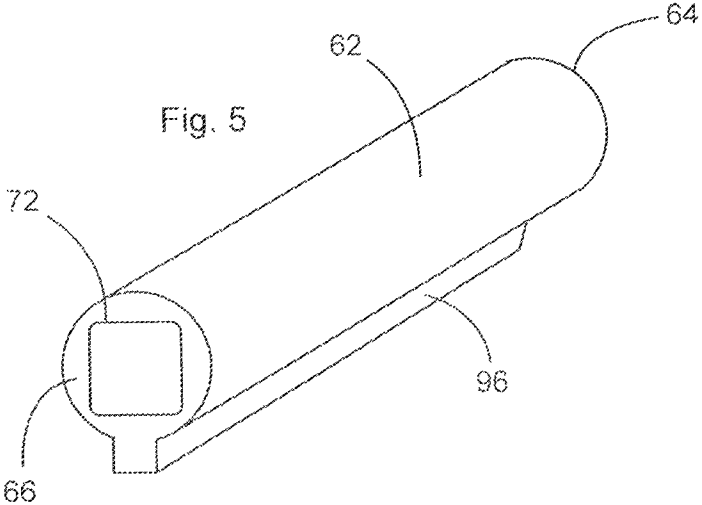
FIG. 5 is a perspective view of the connector tube.
Figure 10:
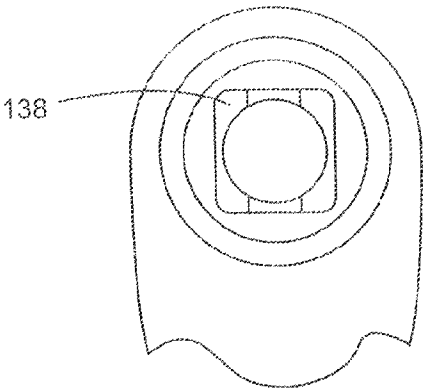
FIG. 10 is the rear view of a pistol grip shaped to connect with the front of the tubular conduit of FIG. 7.
Figure 11:
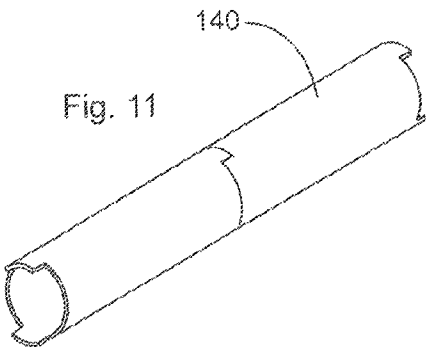
FIG. 11 is a perspective view of two axially aligned tubular conduit sections.
Figure 7:
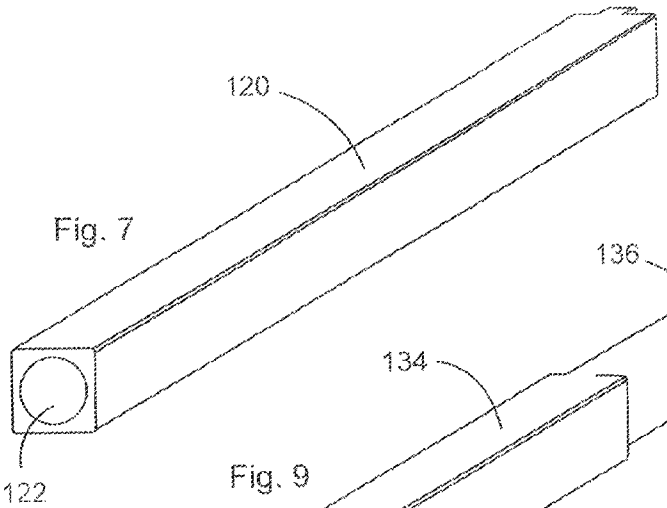
FIG. 7 is a perspective view of an alternate tubular conduit.
Figure 9:
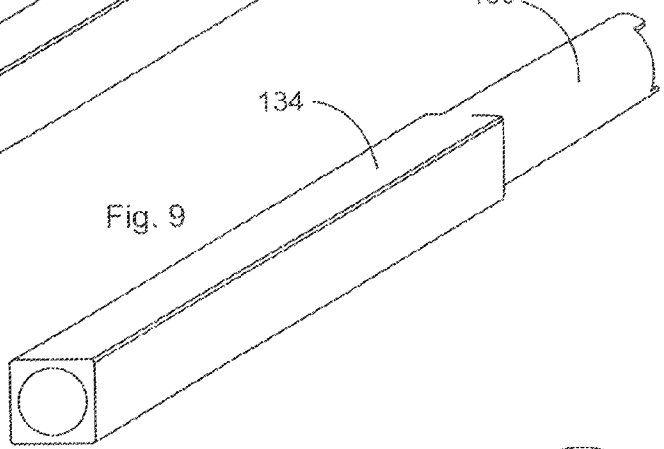
FIG. 9 is a perspective view of still another tubular conduit.
Figure 8:
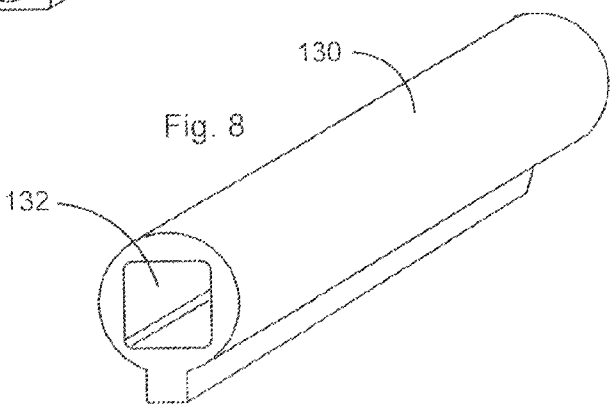
FIG. 8 is a perspective view of an alternate connector tube configured to receive the tubular conduit of FIG. 7.

While the preceding embodiment has advantages in manufacture and assembly, it will be understood that variations thereof are within the scope of the invention. For example, the tubular connector, instead of being constructed of sections 50 and 82, shown in FIGS. 3 and 6, respectively, can be constructed as a single piece. As shown in FIG. 7, tubular conduit 120 has a central spring tube bore 122 and a non-circular, i.e., square, outer cross-section. Conduit 120 is non-rotatably slidable within connector tube 130, shown in FIG. 8, which is constructed the same as connector tube 62, except that bore 132 has a non-circular, i.e., square, cross-section throughout its length, with the cross-section corresponding outer cross-section of conduit 120. Tubular conduit 134 may be rounded end 136 as shown in FIG. 9 to correspond to end 56 of section 50, or the rear face of pistol grip 12 may be modified as shown in FIG. 10 to include a square recess 138. As noted earlier, the tubular conduit may be comprised of a plurality of end-to-end sections 140 as shown in FIG. 11.

Other modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A stock assembly for an autoloading firearm having a receiver with a rear face and a spring tube extending rearwardly from said receiver rear face comprising:

a) a pistol grip having a grip front face positionable against the receiver rear face, a grip back face, and a spring tube bore extending between said grip front and back faces;

b) a stock having a front end, a rear face with a spring tube recess, and a connector tube cavity;

c) a connector tube mountable within said connector tube cavity, said connector tube being attachable at selected positions to said stock, said connector tube having a front end, a back end, and a bore extending between said connector tube front and back ends;

d) a tubular conduit slidably insertable over said spring tube and in said connector tube bore, said tubular conduit being non-rotatable within said connector tube bore and having a front end non-rotatably attachable to said pistol grip;

e) a compressible spring insertable over said tubular conduit and between said connector tube and said pistol grip; and f) a locking member attachable to the rear end of said spring tube securing the front end of said conduit to said pistol grip, said locking member being against the rear ends of said tubular conduit and said connector tube when said spring is uncompressed and spaced from the rear of said connector tube when said spring is compressed.

2. The stock assembly of claim 1, wherein said tubular conduit is comprised of multiple axially aligned sections.

3. The stock assembly of claim 2, wherein at least one of said sections has a non-circular outer cross-section and at least one of said sections has a circular outer cross-section.

4. The stock assembly of claim 1, wherein at least a part of said connector tube bore has a non-circular cross-section and at least a part of said tubular conduit has a non-circular outer cross-section corresponding to and slidable within said connector tube bore cross-section.

5. The stock assembly of claim 1, wherein said connector tube includes a lower protrusion with spaced recesses, and said stock includes a locking pin selectively insertable into a selected recess to lock said connector tube relative to said stock.

6. The stock assembly of claim 1, further including a butt plate positioned over said stock rear face.

7. The stock assembly of claim 1, wherein said pistol grip includes a spring recess in the rear face of said pistol grip, said spring recess being co-axial with said pistol grip.

8. The stock assembly of claim 1, wherein at least one of said pistol grip rear face and said tubular conduit front end has at least one protrusion and the other has a recess sized to receive said protrusion, whereby said tubular conduit is prevented from rotating relative to said pistol grip when said protrusion is inserted into said recess.

9. The stock assembly of claim 1, wherein said spring includes a rear face held against the front end of said connector tube by said locking member.

10. The stock assembly of claim 1, wherein said connector tube front end is spaced from said pistol grip rear face, and said stock includes a cover section extending over said space.

11. A stock assembly for an autoloading firearm having a receiver with a rear face and a spring tube extending rearwardly from said receiver rear face comprising:

a) a pistol grip having a grip front face positionable against the receiver rear face, a grip back face, and a spring tube bore extending between said grip front and back faces, and a spring recess in the grip back lace, said spring recess having a diameter greater than said spring tube bore and being coaxial with said spring tube bore;

b) a stock having a front end, a rear face with a spring tube recess, a connector tube cavity, and a retractable latching member;

c) a connector tube mountable within said connector tube cavity, said connector tube having a front end, a back end, and a connector tube bore with a non-circular cross-section extending between said connector tube front and back ends, said connector tube including spaced recesses to selectively receive said stock latching member to secure said connector tube to said stock;

d) a tubular conduit slidably insertable over said spring tube within said connector tube bore, said conduit having a non-circular outer cross-section slidable and non-rotatable within the non-circular cross-section of said connector tube bore, said tubular conduit having a front end non-rotatably attachable to said pistol grip;

e) a compressible spring insertable over said front tubular conduit and between the front end of said connector tube and extending into said pistol grip spring recess; and f) a locking nut attachable to the rear end of said spring tube to secure the front end of said conduit to said pistol grip and the front end of said pistol grip to said receiver, said nut being against the rear ends of said tubular conduit and said connector tube when said spring is uncompressed and spaced from the rear of said connector tube when said spring is compressed.

12. The stock assembly of claim 11, wherein said tubular conduit is comprised of multiple axially aligned sections, at least one of said sections having a non-circular outer cross-section and at least one of said sections having a circular outer cross-section.

13. The stock assembly of claim 11, wherein said connector tube includes a lower protrusion with said spaced recesses extending upwardly into said protrusion, and said stock latching member is a retractable locking pin selectively insertable into a selected recess to lock said connector tube relative to said stock.

14. The stock assembly of claim 11, wherein at least one of said pistol grip rear face and said tubular conduit front end has at least one protrusion and the other has a recess sized to receiver said protrusion, whereby said tubular conduit is prevented from rotating relative to said pistol grip when said protrusion is inserted into said recess.

15. The stock assembly of claim 11, wherein said connector tube front end is spaced from said pistol grip rear face, and said stock includes a cover section extending over the space between said connector tube and said pistol grip.

16. An autoloading firearm including a receiver with a rear face and a spring tube extending rearwardly from said receiver rear face, said firearm having a stock assembly comprising:

a) a pistol grip having a grip front face positionable against the receiver rear face, a grip back face, and a spring tube bore extending between said grip front and back faces:

b) a stock having a front end, a rear face with a spring tube recess, and a connector tube cavity;

c) a connector tube mounted within said connector tube cavity, said connector tube being attachable at selected positions to said stock, said connector tube having a front end, a back end, and a bore extending between said connector tube front and back ends;

d) a tubular conduit slidably inserted over said spring tube and in said connector tube bore, said tubular conduit being slidable and non-rotatable within said connector tube bore, said tubular conduit having a front end non-rotatably attached to said pistol grip;

e) a compressible spring inserted over said front tubular conduit and between said connector tube and said pistol grip; and f) a locking nut attached to the rear end of said spring tube securing the front end of said conduit to said pistol grip, said nut being against the rear end of said connector tube when said spring is uncompressed and spaced from the rear of said connector tube when said spring is compressed.

17. The firearm of claim 16, wherein said tubular conduit is comprised of multiple axially aligned sections, at least one of said sections having a non-circular outer cross-section and at least one of said sections having a circular outer cross-section.

18. The firearm of claim 16, wherein said connector tube bore has a non-circular cross-section and said tubular conduit has a non-circular outer cross-section corresponding to said connector tube bore cross-section.

19. The firearm of claim 16, wherein at least one of said pistol grip rear face and said tubular conduit front end has at least one protrusion and the other has a recess sized to receiver said protrusion, whereby said tubular conduit is prevented from rotating relative to said pistol grip when said protrusion is inserted into said recess.

20. The firearm of claim 16, wherein said connector tube front end is spaced from said pistol grip rear face, and said stock includes a cover section extending over the space between said connector tube and said pistol grip.

* * * * *